United States Patent [19]

Furuya

[11] 4,039,398

[45] * Aug. 2, 1977

[54] METHOD AND APPARATUS FOR ELECTROLYTIC TREATMENT

[75] Inventor: Kiyoto Furuya, Yokohama, Japan

[73] Assignee: Daiichi Denshi Kogyo Kabushiki Kaisha, Tokyo, Japan

[ * ] Notice: The portion of the term of this patent subsequent to Mar. 29, 1994, has been disclaimed.

[21] Appl. No.: 605,024

[22] Filed: Aug. 15, 1975

[51] Int. Cl.[2] ..... C25D 5/02; C25D 5/04; C25D 17/00

[52] U.S. Cl. ..... 204/15; 204/28; 204/206; 204/207

[58] Field of Search ..... 204/28, 206, 207, 208, 204/209, 210, 211, 15

[56] References Cited

U.S. PATENT DOCUMENTS

| | | | |
|---|---|---|---|
| 2,370,973 | 3/1945 | Lang | 204/28 X |
| 2,395,437 | 2/1946 | Venable | 204/206 |
| 2,725,355 | 11/1955 | Gray | 204/208 |
| 2,823,180 | 2/1958 | Rothschild | 204/207 |
| 2,974,097 | 3/1961 | Ramirez et al. | 204/206 |
| 3,616,426 | 10/1971 | Nakao et al. | 204/207 |
| 3,622,470 | 11/1971 | Gowman | 204/207 X |
| 3,865,698 | 2/1975 | Kosowsky et al. | 204/15 |
| 3,865,701 | 2/1975 | Borgmann | 204/28 |

*Primary Examiner*—G. L. Kaplan
*Attorney, Agent, or Firm*—Silverman & Cass, Ltd.

[57] ABSTRACT

A method and an apparatus for effecting in succession electrolytic processes and other processes such as water washing in connection therewith, comprising a series of treating units respectively for the electrolytic and other processes, the treating units being arranged in row in the order of the processes. Each treating unit consists of first and second unit halves one upon the other, the unit halves comprising a through passage for feeding the material and at least one insulating passage for flowing a treating liquid onto surfaces of the material, and the units for the electrolytic processes being further provided with electrodes for causing electric current to flow between the electrodes and the material.

21 Claims, 19 Drawing Figures

(K)
DRYING
(H)
WATER WASHING
(G)
PLATING
(F)
WATER WASHING
(E)
PICKLING
(D)
WATER WASHING
(C)
ELECTROLYTIC DEGREASING
(B)
ALKALI DEGREASING
(I)
(J)

METHOD AND APPARATUS FOR ELECTROLYTIC TREATMENT

BACKGROUND OF THE INVENTION

1. Field of the Invention

This invention relates to a method of effecting a series of processes in connection with electrolytic process, for example, electroplating process in simple and rapid manner with small type means, and more particularly, to an apparatus for carrying out such a series of processes.

2. Description of the Prior Art

Heretofore, to effect a series of processes of materials as wires, which are electroplating and other chemical processes in connection therewith, for example, degreasing, pickling or water rinsing or washing processes, it has been required to employ great bulky apparatuses which may occupy large spaces in factories. Accordingly, it has been attempted in the art to effect plating process and other processes in connection therewith with smaller plants as much as possible. However, such smaller plants might treat only small amounts of materials per unit hour. Alternatively, it has been suggested to treat simultaneously a number of materials in parallel in order to overcome the low efficiency of the small plant. Such an alternative apparatus, however, is unsatisfactory because it requires a complicated transferring mechanism for the materials, as well as several sets of a series of plating plants in rows, which will considerably increase the cost of equipment.

Moreover, in the prior art plating apparatus, rollers have been used to bend a material for immersing it into a treating liquid, so that the material is subjected to a great force resulting from the action of the rollers which will give rise to deformation and breakage of the material and limitation of feeding speed of the material to obstruct the speedup of the treatment. Apparatuses intended to avoid these disadvantages require transferring mechanisms of higher accuracy and are apt to be more bulky and expensive. If the rollers are made smaller in diameter, there is a tendency of the rollers to severely act on the material to give a permanently residual deformation therein and if the straightening of such a deformed materials is difficult, sufficiently large rollers in diameter must be used to avoid the residual deformation, which in turn require a series of bulk apparatuses.

Furthermore, in the prior art it is inherently difficult to effect sufficient water washing or pickling, so that the treated material is often short of uniformity in quality. It also requires a great amount of water for washing which will increase the cost for treating the drainage of the water. Since the treating liquid is generally contained in a top opened bath which includes noxious or powerful material for the treatment, this noxious liquid will evaporate and splash in a workroom, so that the environment in the room becomes a dangerous condition for workmen.

SUMMARY OF THE INVENTION

A primary object of the invention is, therefore, to provide a novel method and an apparatus for effecting a series of processes in connection with electrolytic process, which overcome all the disadvantages of the prior art above described.

In one aspect, the invention provides an electrolytic treating method comprising steps of feeding a material in succession through a series of units for electrolytic processes and other processes in connection therewith, said units being provided with through passages for said material and passages for treating liquids and the units for said electrolytic processes being further provided with electrodes for causing electric current to flow through said treating liquid between said material and electrodes; causing treating liquids to flow through said respective passages for said treating liquids of said units; and causing electric current to flow between said material and electrodes, theregy continuously effecting said series of processes on said material.

In another aspect, the invention provides an electrolytic treating apparatus for effecting in succession electrolytic processes and other processes in connection therewith, said apparatus comprising a series of treating units respectively for said electrolytic processes and other processes in connection therewith, said treating units being arranged in row in the order of the processes, said treating units, each consisting of first and second unit halves one upon the other, said unit halves comprising a through passage for feeding said material and at least one insulating passage for flowing a treating liquid onto surfaces of said material transferred through said through passage and said units for said electrolytic processes being further provided with electrodes for causing electric current to flow between the electrodes and the material.

The above and other related objects and features of the invention will be apparent from the following description of the disclosure found in the accompanying drawings.

DESCRIPTION OF THE PREFERRED EMBODIMENTS

Figure 1:
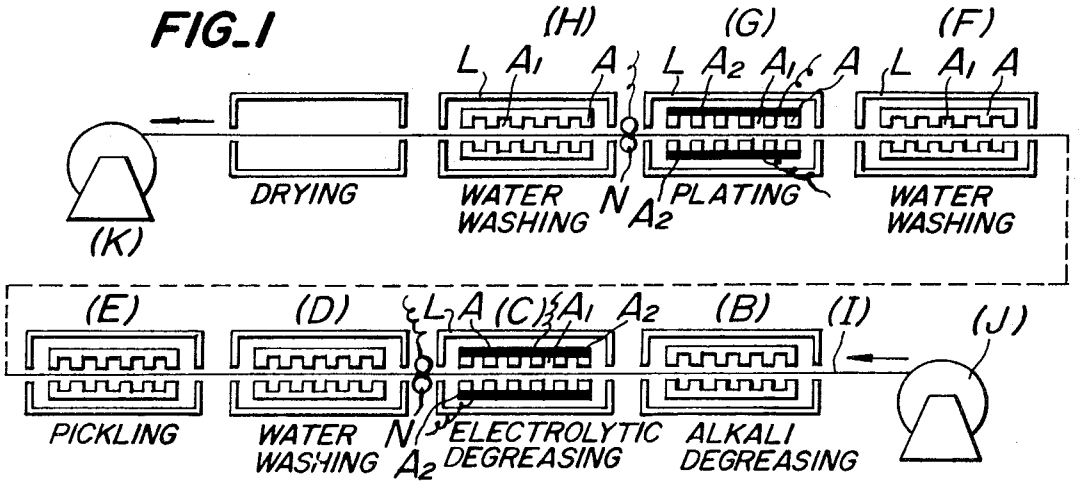
FIG. 1 is a diagrammatical illustration showing a series of processes according to the invention.

Referring first to FIG. 1 which illustrates a preferred embodiment of the invention, there is shown a series of various treating units A according to a series processes such as alkali degreasing process B, electrolytic degreasing process C, a water washing process D, a pickling process E, a water washing process F, a plating process G and a water washing process H, through which units a material I such as an elongated strip or hoop material to be treated is fed from a delivery unit J to a take-up unit K located at upstream and downstream ends of the processes such that the material is subjected to a series of treatments with treating liquids each passing through passages A1 in each treating unit A for the purpose of plating the material. The units for pickling, water washing and degreasing processes are provided with the passages A1 for pickling solution or rinsings respectively, while the units for plating and electrolytic degreasing processes are further provided with electrodes A2 for causing electric current to flow to the material through the treating liquid. All the units are substantially essentially the same in construction with the exception that the units for electrolytic processes have the electrodes.

Figure 2B:
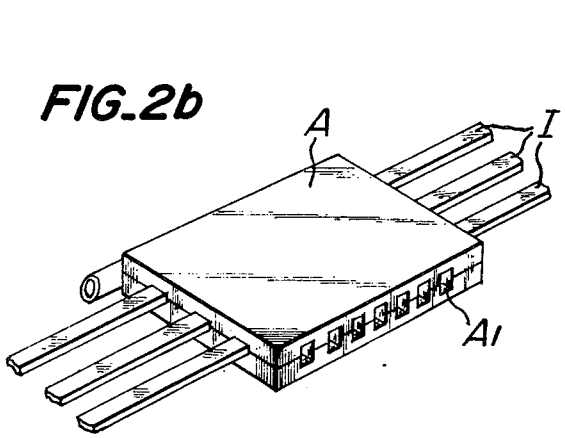
FIG. 2*b* is a perspective view of a unit for treating a plurality of materials simultaneously.
Figure 2A:
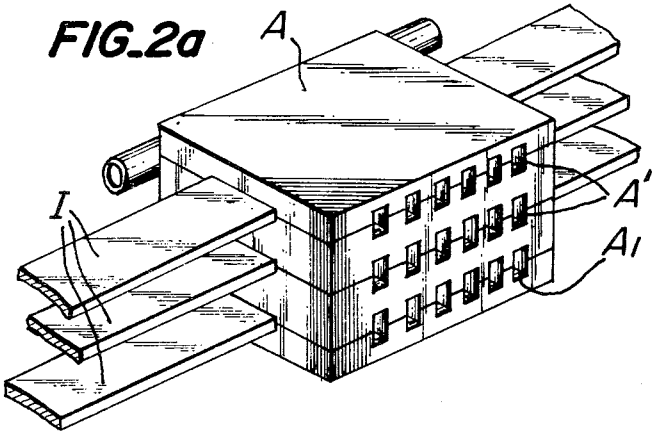
FIG. 2*a* is a perspective view of units piled upon the other for treating a plurality of materials simultaneously according to the invention.
Figure 3A:
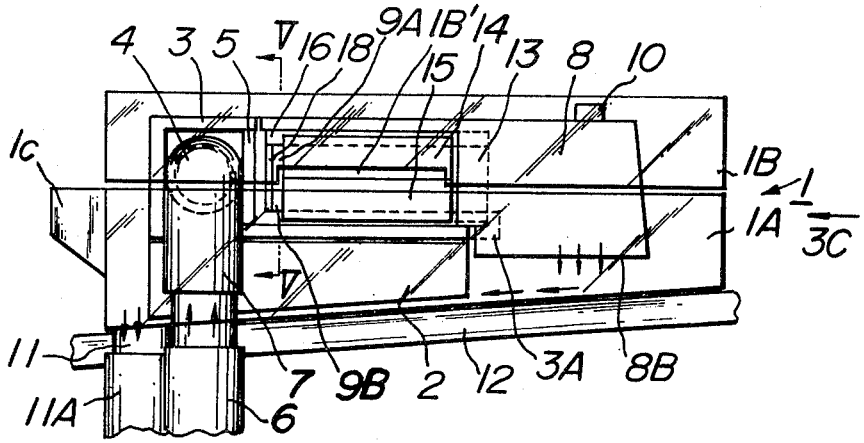
FIG. 3*a* is a side elevation of an apparatus according to the invention showing the inside thereof through its casing.
Figure 3B:
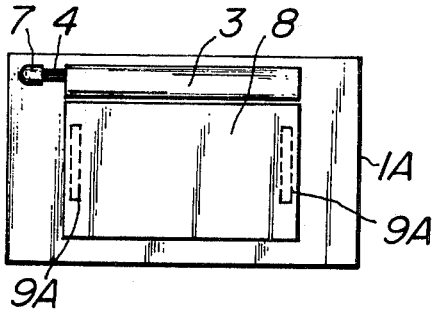
FIG. 3*b* is a plan view after removal of a casing of the apparatus shown in FIG. 3*a;*
Figure 3C:
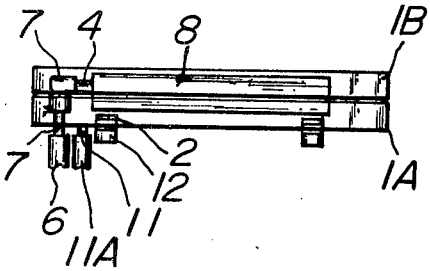
FIG. 3*c* is a front elevation of the apparatus as viewed in arrow 3*c;*
Figure 4B:
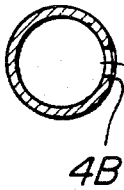
FIG. 4*b* is a sectional view of the supply pipe as shown in FIG. 4*a;*
Figure 4A:
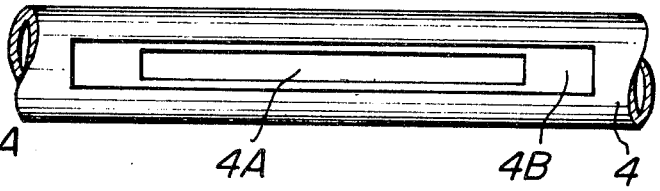
FIG. 4*a* is a front elevation of a supply pipe for a treating liquid used in the apparatus as shown in FIG. 3*a;*

According to the invention a material to be treated is tranferred in the flowing treating liquids in this manner to effect a series of the treatments without using rollers as in the prior art for bending the material for immersing it into a treatment bath such as a plating bath. According to the invention, therefore, the apparatus for effecting these series of processes can be made relatively small and there is no risk of any deformation and breakage of the material in spite of a considerably high speed feeding of the material. Furthermore, according to the invention, the treatment of the material can be effected at high speed with relatively small amounts of treating liquids by increasing the flowing speed of the liquids. Particularly this makes it easy to drain the water used in the water washing process. In addition, the apparatus according to the invention performs simultaneously a treatment of a plurality of materials in parallel by the use of a series of units each having a plurality of treating units for each process or each capable of passing a plurality of materials through one treating unit as shown in FIGS. 2*a* and 2*b*. Since a material is fed without bending it according to the invention, a material which could not be bent can be subjected to a series of treatments. The treating units according to the invention are so compact in construction that they can be enclosed or sealed by a casing or cover L thereby completely eliminating an unsanitary condition in the prior art resulting from an evaporation of noxious gases from the treating liquid.

Figure 5:
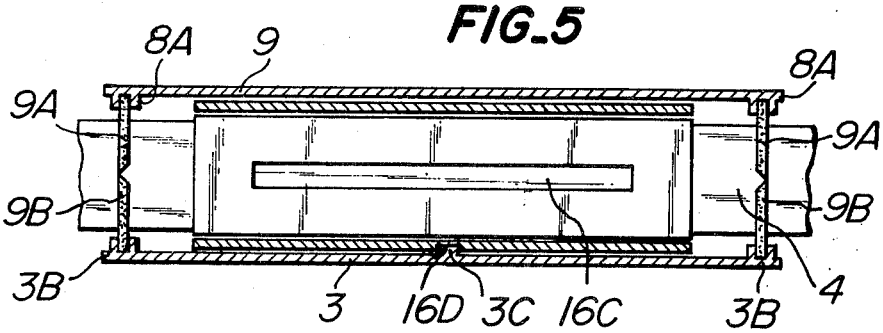
FIG. 5 is a sectional view taken along the line V—V in FIG. 3*a* after removal of the treatment unit.

FIGS. 3–8 show preferred embodiments of the apparatus for treating elongated materials according to the invention. In FIGS. 3*a*–3*c*, a casing 1 for a treating unit consists of a bottom casing half 1A and a cover or an upper casing half 1B hinged therewith and formed with a rectangular slit 1B' for feeding the material into the treating unit. A stopper 1C controls the extremely opened position of the cover or upper casing half 1B. As shown in FIGS. 3*a*–3*c*, the apparatus comprises a base 2 fixed to the underside of the bottom casing half 1A, a U-shaped unit fitting 3 fixed onto the base 2, whose lower arm is longer than the upper arm, which is wider than the length of the unit in the direction feeding the material and providing at the free end of the lower arm with a hook portion 3A of the unit supported by a holder which will be explained later. A treating liquid supply pipe 4 is supplied with the liquid through a hose 6 and a joint 7 fixed to the fittings 3. The supply pipe 4 is formed with a rectangular injection opening 4A for the treating liquid as shown in FIG. 4*a* and a mating surface 4B in contact with an injection opening 16C of a holder 16 later described through a packing 5 having an injection opening the same in shape as the opening 16C. A hood 8 having substantially the same width as the fitting 3 is pivotally connected to the upper portion of the fitting 3 by means of hinges for introducing the liquid exhausted from passages into the bottom of the bottom casing 1A when the hood is in a closed position covering the treating unit. Wipers 9A and 9B are located at inlet and outlet for the material to be treated (FIG. 3*a*) for wiping away the residual liquid on the material after a pretreatment and a treatment to prevent the liquid from entering a next process and from flowing out of the casing. The wipers are made of flexible plates such as rubber plates and mounted within fixtures 8A and 3B at the ends of upper and lower sides of the hood 8 and fitting 3 so as to be in contact with each other with their ends as shown in FIG. 5. A stopper 10 serves to suppress the hood 8 when the cover 1B is closed. An exhausting pipe 11 is connected to a hose 11A for exhausting the liquid from a lower open end 8B of the hood 8 flowing down the oblique bottom of the bottom casing 1A to return the liquid into for example a reservoir for a plating liquid. The casing 1 including the above assembly is located on an oblique base 12 with the oblique bottom so that the treating unit is substantially horizontal. A numeral 13 denotes a treating unit made of an electrically insulating material supported by the holder 16, which is illustrated in detail in FIGS. 6*a*, 6*b* and 6*c*.

Figure 6A:
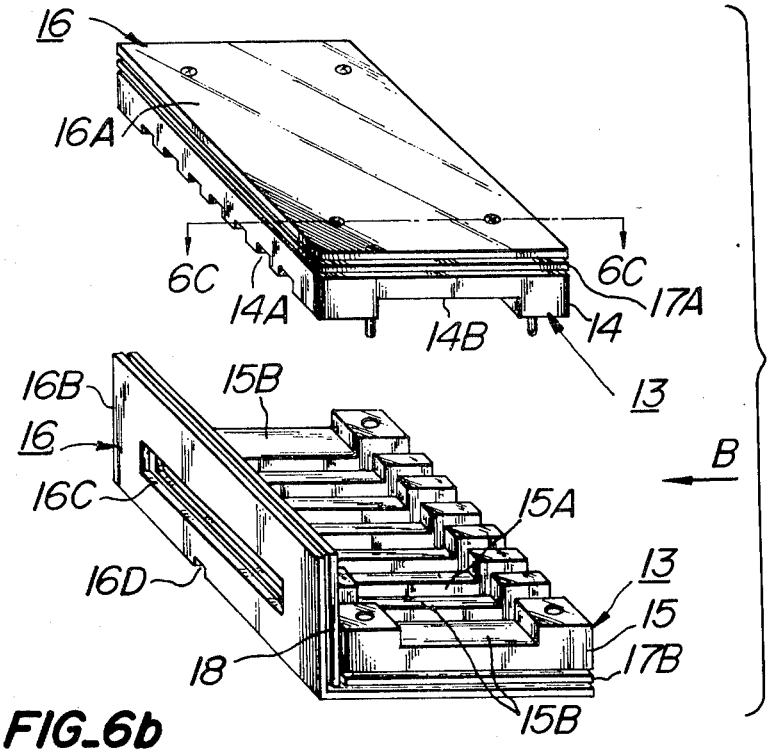
FIG. 6*a* is an exploded perspective view of the unit secured to a holer used in the apparatus according to the invention.
Figure 6B:
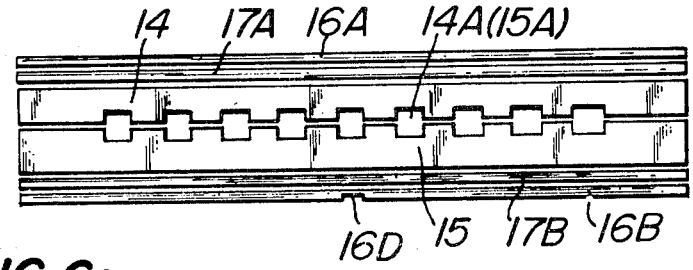
FIG. 6*b* is a front elevation of the unit in FIG. 6*a;*
Figure 6C:
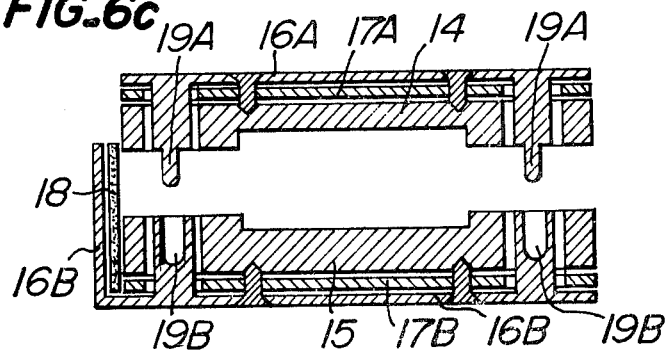
FIG. 6*c* is a sectional view taken along line 6C—6C in FIG. 6*a;*
Figure 7A:
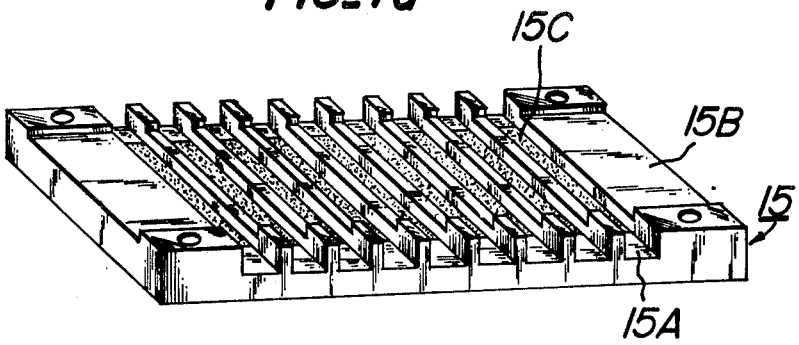
FIGS. 7*a*, 7*b* and 7*c* shows respective unit halves of the other embodiments of the invention.
Figure 7B:
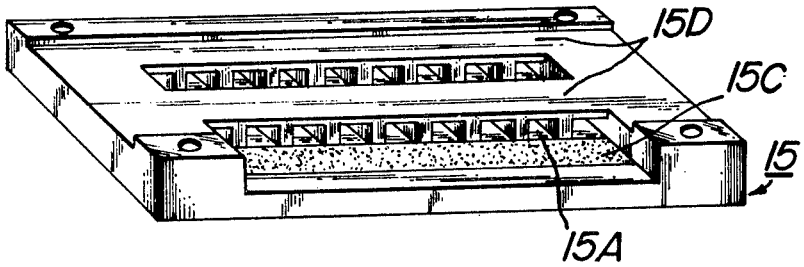
Figure 7C:
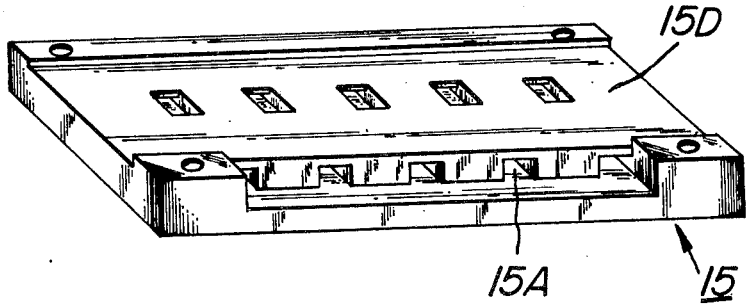
Figure 8A:
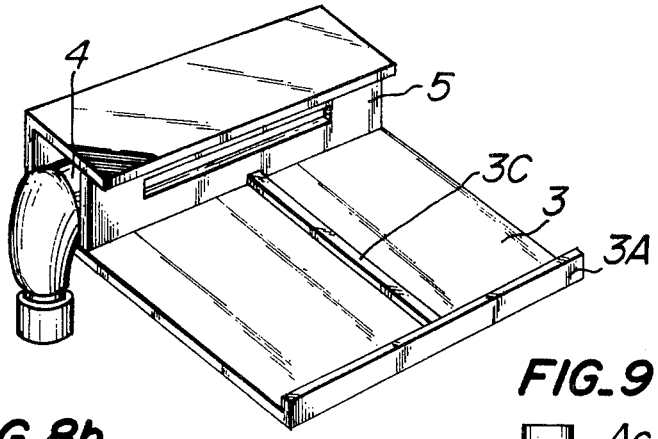
FIG. 8*a* is a perspective view of a fitting for the unit halves according to the invention.
Figure 8B:
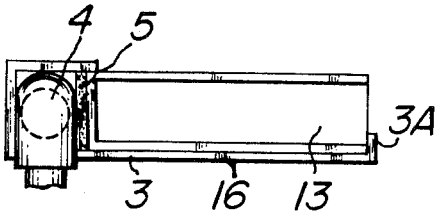
FIG. 8*b* is a side elevation of the fitting shown in FIG. 8*a* equipped with the holder.

Referring to FIGS. 6*a*, 6*b* and 6*c*, the treating unit 13 is divided into two parts, that is, first and second unit halves 14 and 15 to facilitate passing the material through the unit and formed with passages 14A and 15A for the treating liquid and with flat cut portions 14B and 15B to form a through passage for feeding and transferring a flat material, for example, a hoop material. In case of a unit for plating or electrolytic degreasing process, there is provided with electrodes 14C and 15C for example as shown in FIG. 7*a* (only the electrodes provided in the second unit are shown). In case of partial plating process, there is further provided with insulating shields 14D and 15D as shown in FIGS. 7*b* and 7*c* for partially plating only desired portions of the material to be plated. The shields are adapted to be in close contact with the surfaces of the material to be treated for preventing electric current from flowing from the electrodes onto portions of the material not to be plated and further preventing the plating liquid from flowing onto the portions of the material not to be plated. It is to be understood that the treating units for water washing, pickling and degreasing processes are provided with the passages 14A and 15A for the treating liquids and the flat cut portions 14B and 15B without the electrodes 14C and 15C.

In this manner according to the invention the material to be treated is continuously fed through a series of the treating units at the through passages consisting of flat cut portions 14B, 15B whie the treating liquid is caused to pass through each of the units at the passages 14A and 15A in a direction substantially at right angle to that of the material and electric current is caused to flow between the material and the electrodes 14C and 15C in the units for plating and electrolytic degreasing processes.

Referring back to FIGS. *6a, 6b* and *6c*, the holder 16 consists of an upper fixing plate 16A to which is fixed the first unit half 14 through an insulating plate 17A by means of setscrews and an L-shaped lower fixing plate 16B formed with an injection opening 16C for treating liquid, to which is fixed the second unit half 15 by means of setscrews through an insulating plate 17B and a packing 18 having an opening the same in shape as the injection opening 16C for the treating liquid. The insulating plates 17A and 17B may be dispensed with, as the case may be. The upper and lower fixing plates 16A and 16B of the holder 16 are provided at their four corners with positioning protrusions and holes 19A and 19B (FIG. *6c*), and when the protrusions 19A are inserted into the holes 19B after the first and second unit halves 14 and 15 have been attached to the upper and lower fixing plates 16A and 16B, respectively, the first and second unit halves are precisely in registry with each other to form the passages 14A, 15B for treating liquid and the through passage 14B, 15B for feeding the material to be treated. The lower fixing plate 16B is mounted on the fitting 3 in a manner such that a central ridge 3C of the fitting 3 is received in an elongated recess 16D (FIG. *8a* and *8b*) formed in the underside of the lower fixing plate 16B in the same direction as the passages 14B. The holder 16 with the unit 13 is thus held in place between the supply pipe 4 and the hook portion 3A as shown in FIG. *8b.* When the apparatus has thus been assembled, the injection opening 16C formed in the vertical plate of the L-shaped lower fixing plate 16B is in registry with the openings of the packing 5 and the supply pipe 4.

According to the invention, the treating units having the electrodes for plating and degreasing process and the treating units without any electrode for rinsing, pickling or alkali degreasing process are in series arranged at a constant level as shown in FIG. 1 so as to be able to pass a material I to be treated through the thus arranged units. With the apparatus thus assembled, the treating liquid is forced from a tank (not shown) to the passages 14A, 15A through the hose 6, the joint 7, the supply pipe 4 and the openings 4A, 16C and returned to the tank through the hood 8, the oblique bottom of the bottom casing 1A and the exhaust pipe 11. The required amounts of treating liquids are circulated through the respective treating units in this manner and the material I to be treated is transferred from the delivery unit J to the take up unit K, while voltage is applied between the material I and the electrodes in the plating and electrolytic degreasing units, one terminal of a power source being connected through roller electrodes N to the material and the other terminal of the power source being connected to the electrodes of the plating and electrolytic degreasing units. In this manner the material can be subjected to a series of the processes in connection with the plating process.

Figure 9:
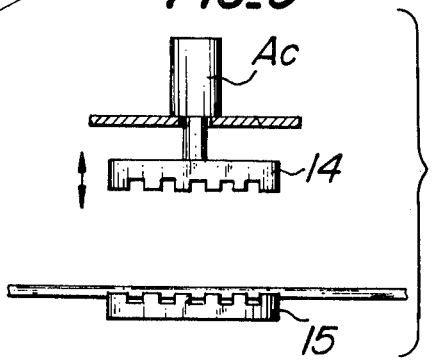
FIG. 9 is an explanatory view showing an arrangement for treating a material which cannot be bent in the treatment unit according to the invention.

It has been described in the above description that after the material has been embraced in respective units each dividable into the first and second unit halves, this assembly is mounted onto the fitting. However, after the second unit half secured to a fixing plate has been mounted onto a fitting, the material to be treated and the first unit half secured to a fixing plate may be applied to the second unit half. As shown in FIG. 9, the first unit half 14 may be raised by the use of a pneumatic cylinder AC or the like, and after the material to be treated has been arranged on the second unit half 15, the first unit half 14 may be lowered onto the second unit half 15.

Figure 10:
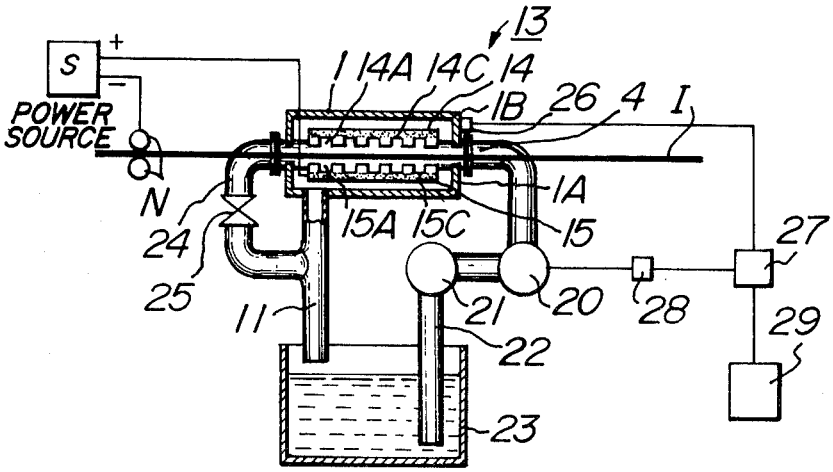
FIG. 10 shows an exemplary arrangement for supplying the treating liquid to the treating unit according to the invention.

FIG. 10 shows an advantageous means for supplying the treating liquid to the treating unit 13 which is for plating or electrolytic decreasing process. The unit 13 consists of the first and second unit halves 14, 15 provided with the passages 14A, 15A for the treating liquid and the electrodes 14C, 15C and has the casing 1 consisting of the bottom casing half 1A and the cover or upper casing half 1B. A positive terminal of a power source S is connected to the electrodes 14C, 15C, while a negative terminal of the power source S is connected through roller electrodes N to a material I to be treated. The treating liquid is forced by a pump 20 from a tank 23 to the passages 14A, 15A through a suction pipe 22, a filter 21 and a supply pipe 4 and is returned to the tank 23 through an exhausting pipe 11 having a bypass pipe 24. The bypass pipe 24 includes an adjustable valve 25 of which opening is adjustable to regulate the flow of the treating liquid flowing through the passages 14A, 15A in the unit 13. The numeral 26 denotes a switch adapted to be opened when the cover 1B of the casing is opened for the purpose of charging the material or an inspection of the unit. The opening of the switch 26 makes a relay 27 cut off a power source 29 for the pump 20 to stop the supply of the treating liquid. As an alternative, the power source S for the electrodes may be turned off simultaneously when the power source 29 is cut off by the relay 27. The switch 26 may be used as lock means for the cover of the casing, which is so controlled by a manually operated switch 28 that the cover is never opened when the pump 20 is operating. If the treating unit for water washing process is provided with electrodes, it will be possible to effectively remove residual liquids for pickling and plating adhering to the material with gases evolved from the material when electrolyzing.

It can be seen from the above description that according to the invention, plating, chemical, water washing processes and the like can be effected at a high speed with relatively small amounts of treating liquids in a relatively small and compact apparatus without any risk of deformation and breakage of the material to be treated. The treating units are so compact in construction that it can easily be enclosed or sealed by a casing which makes it possible to use a small type ventilator to exhaust gases and steams evolved from the treating liquids for maintaining a workshop in a good sanitary condition.

It is understood by those skilled in the art that the foregoing description is a preferred embodiment of the disclosed apparatus and that various changes and modifications may be made in the invention without departing from the spirit and scope thereof.

What is claimed is:

1. An electrolytic treating method comprising steps of feeding a material in succession through a series of units for electrolytic processes and other processes in connection therewith, said units being provided with through passages for said material and passages for treating liquids and the units for said electrolytic processes being further provided with electrodes for causing electric current to flow through said treating liquid between said material and electrodes; causing treating liquids to flow through said respective passages for said treating liquids of said units; restricting the flow to a plurality of discrete small volume straight line paths transverse the direction of travel of said material and in a direction perpendicular thereto and causing electric current to flow between said material and electrodes in the direction of travel of said material while the treating liquids flow transverse the same thereby continuously effecting said series of processes on said material.

2. A method as set forth in claim 1, wherein each said unit comprises a casing having an opening for feeding said material to be treated, and each said unit consists of first and second unit halves one upon the other and enclosed in said casing, said unit halves comprising the through passage for said material, at least one insulating passage for said treating liquid and said electrodes for causing electric current to flow between said electrodes and the material.

3. A method as set forth in claim 1, wherein each said unit is so constructed that a plurality of materials are fed to be treated simultaneously.

4. A method as set forth in claim 4, wherein said unit is provided with a plurality of through passages for feeding said plurality of materials to be treated simultaneously.

5. A method as set forth in claim 1, wherein said unit is made of a plurality of the units piled up, thereby enabling a plurality of materials to be treated simultaneously.

6. A method as set forth in claim 1, wherein said material is subjected in succession to cleaning, plating and final cleaning processes.

7. A method as set forth in claim 1, wherein said material is subjected in succession to alkali degreasing, electrolytic degreasing, water washing, pickling, second water washing, electroplating and third water washing processes.

8. A method as set forth in claim 1 wherein only one surface of said material is treated so as to minimize the volume of treating fluid required completely to effect treatment.

9. An electrolytic treating apparatus for effecting in succession electrolytic processes and other processes in connection therewith, said apparatus comprising a series of treating units respectively for said electrolytic processes and other processes in connection therewith, said treating units being arranged in row in the order of the processes, said treating units, each consisting of identical first and second unit halves seated one upon the other, said unit halves comprising first means defining a through passage for feeding said material and second means defining at least one insulating passage for flowing a treating liquid onto surfaces of said material transferred through said through passage, said insulating passage being formed as a plurality of discrete chambers disposed relative to said through passage to direct treating fluids in a straight line path transverse the flowing material and perpendicular to the direct of travel thereof, and said units for said electrolytic processes being further provided with electrodes for causing electric current to flow between the electrodes and the material.

10. An apparatus as set forth in claim 9, wherein said unit halves further comprising at least one insulating shield for shielding portions of the material not to be treated.

11. An apparatus as set forth in claim 9, wherein said unit halves further comprising a casing having an opening for feeding the material.

12. An apparatus as set forth in claim 9, wherein each said unit is so constructed that a plurality of materials are fed to be treated simultaneously.

13. An apparatus as set forth in claim 12, wherein said unit is made of a plurality of the units piled up, thereby enabling a plurality of materials to be treated simultaneously.

14. An apparatus as set forth in claim 12, wherein said first means define a plurality of through passages for feeding said plurality of materials to be treated simultaneously.

15. An apparatus as set forth in claim 9, wherein said respective units are arranged in row in the order of the processes to which the material is subjected.

16. An apparatus as set forth in claim 9, wherein said units are arranged in row such that said material is subjected to said processes in the order of alkali degreasing, electrolytic degreasing, water washing, pickling, second water washing, electroplating and third water washing processes.

17. An apparatus as set forth in claim 9, further comprising a unit for drying the material next to the unit for the third water washing and units for delivering and taking up the material arranged at upstream and downstream sides of the series of the units.

18. An apparatus as set forth in claim 9, wherein there are provided roller electrodes in contact with the material for supplying electric current to the material.

19. An apparatus as set forth in claim 9 wherein said second means comprise a plurality of upstanding ridges formed in each of said first and second halves, said ridges being mateable to define said discrete chambers.

20. An apparatus as set forth in claim 9 wherein said plurality of chambers are in contact with only a single surface of the material being treated so as to minimize the quantity of treating fluids required to complete the treating process.

21. An apparatus as set forth in claim 9 wherein said electrodes are positioned at opposite sides of those channels in which they are provided whereby to be capable of directing electrical energy over said material in a direction parallel with the direction of flow thereof and while the said material is in contact with the treating fluid.

* * * * *